US008453707B2

(12) United States Patent
Lambridis et al.

(10) Patent No.: US 8,453,707 B2
(45) Date of Patent: Jun. 4, 2013

(54) TWO-MOTOR DRIVE ARRANGEMENT FOR A ROLLER CURTAIN

(75) Inventors: Andrew C. Lambridis, Brooklyn, NY (US); Ashraf Gomaa, Staten Island, NY (US)

(73) Assignee: McKeon Rolling Steel Door Co., Ltd., Bellport, NY (US)

( * ) Notice: Subject to any disclaimer, the term of this patent is extended or adjusted under 35 U.S.C. 154(b) by 489 days.

(21) Appl. No.: 11/879,151

(22) Filed: Jul. 16, 2007

(65) Prior Publication Data

US 2009/0020237 A1 Jan. 22, 2009

(51) Int. Cl.

| | |
|---|---|
| ***E06B 9/56*** | (2006.01) |
| ***A47G 5/02*** | (2006.01) |
| ***A47H 1/00*** | (2006.01) |
| ***E05F 11/00*** | (2006.01) |
| ***E05F 13/00*** | (2006.01) |
| ***E05F 15/00*** | (2006.01) |

(52) U.S. Cl.
USPC ..... 160/312; 160/188; 160/313

(58) Field of Classification Search
USPC ..... 160/133, 188, 189, 191, 192, 238, 160/310, 311, 312, 313, 316, 317, 318, 323.1; 242/372; 267/168, 238, 290, 212; 49/197, 49/199, 200
See application file for complete search history.

(56) References Cited

U.S. PATENT DOCUMENTS

| | | | | | |
|---|---|---|---|---|---|
| 129,893 | A | * | 7/1872 | Knapp | 160/303 |
| 310,658 | A | * | 1/1885 | Eddy | 160/315 |
| 798,203 | A | * | 8/1905 | McCloud | 160/9 |
| 1,709,271 | A | * | 4/1929 | McCloud et. al. | 160/7 |
| 4,644,813 | A | * | 2/1987 | Whitehouse et al. | 74/431 |
| 4,882,806 | A | | 11/1989 | Davis | |
| 4,930,182 | A | | 6/1990 | Eichenberger | |
| 5,172,744 | A | * | 12/1992 | Finch et al. | 160/133 |
| 5,201,897 | A | * | 4/1993 | Whiting | 267/155 |
| 5,275,223 | A | | 1/1994 | Magro et al. | |
| 5,372,173 | A | * | 12/1994 | Horner | 160/98 |
| 5,775,619 | A | * | 7/1998 | Tabellini | 242/372 |
| 5,865,235 | A | | 2/1999 | Krupke et al. | |
| 5,996,670 | A | | 12/1999 | Igarashi | |
| 6,122,862 | A | | 9/2000 | Hormann | |
| 6,123,140 | A | | 9/2000 | Bergamaschi | |
| 6,134,835 | A | * | 10/2000 | Krupke et al. | 49/200 |
| 6,260,601 | B1 | | 7/2001 | Thomas | |
| 6,942,003 | B2 | | 9/2005 | Thompson | |

* cited by examiner

*Primary Examiner* — Katherine Mitchell
*Assistant Examiner* — Jeremy Ramsey
(74) *Attorney, Agent, or Firm* — Cozen O'Connor

(57) ABSTRACT

A drive arrangement for a roller curtain covering an opening defined by a frame includes a drum mounted horizontally across one side of the opening, a pair of hollow drive shafts fixed against rotation in opposite ends of the drum, and a pair of coaxial tension shaft portions fixed to the frame and received through respective hollow drive shafts. At least one coil spring is associated with each tension shaft portion, each spring having a first end fixed to a tension shaft portion and a second end fixed to the drum. A pair of drive motors are operatively connected to respective hollow drive shafts for synchronously rotating the drive shafts in order to coil a roller curtain on the drum.

24 Claims, 4 Drawing Sheets

TWO-MOTOR DRIVE ARRANGEMENT FOR A ROLLER CURTAIN

BACKGROUND OF THE INVENTION

1. Field of the Invention

The invention relates a drive arrangement for a spring-loaded roller curtain, which is wound on a horizontally mounted drum.

2. Description of the Related Art

Roller curtains for covering large openings such as hallways and open walls in buildings are well known. As used herein the term "roller curtain" will be understood to mean a plurality of slats that are hinged together so that the curtain can be wound on a drum. Such slats may be either insulated or uninsulated, and the gauge of the metal may vary depending on the application, e.g. as acoustical barriers or fire doors. Hinging and mounting arrangements are well known and will not be discussed herein.

A roller curtain is typically wound on a drum by driving the drum in rotation using an electric motor. Counter-balance systems employing torsionally loaded coil springs are well known for reducing the torque necessary to rotate the drum, especially for a vertical coiling type door. For doors that are particularly large and heavy, counterbalance systems employing several sets of concentrically arranged coil springs are necessary.

The springs are chosen and arranged so that the door is nearly "weightless" when closed. For a large door, this may require several sets of springs arranged axially, with concentrically arranged springs in each set.

While the force provided by the springs decreases as the drum rotates and the curtain is raised, the weight of the hanging curtain also decreases as the curtain is wound on the drum. However, the decreasing weight is somewhat offset by the increasing effective diameter of the drum, which increases the moment arm. The system is preferably engineered so that the load on the motors is as uniform as possible as the door curtain is lowered or raised.

Notwithstanding the use of a counterbalance spring system, the load on the motor can still cover a substantial range, particularly for a large door. For example, on a roller curtain-type rated fire door that is 50 feet wide and 20 feet high, the torque output required to raise the door could be in a range of 38,000 in-lb to 90,000 in-lb.

SUMMARY OF THE INVENTION

According to the invention, an electric drive motor is provided at each end of the drum. This not only permits using smaller motors, but balances the system so that torsional stresses on drive components are reduced. It may also reduce the voltage requirements, e.g. from 220 v to 110 v, so that uprated wiring is not required for the building. In the example given above, an electric motor rated at 3151 in-lb can be used on each side, as opposed to the single motor rated at 6417 in-lb on one end only. If one of the motors fails, it may be still be possible to open the door using the surviving motor and a manual assist.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
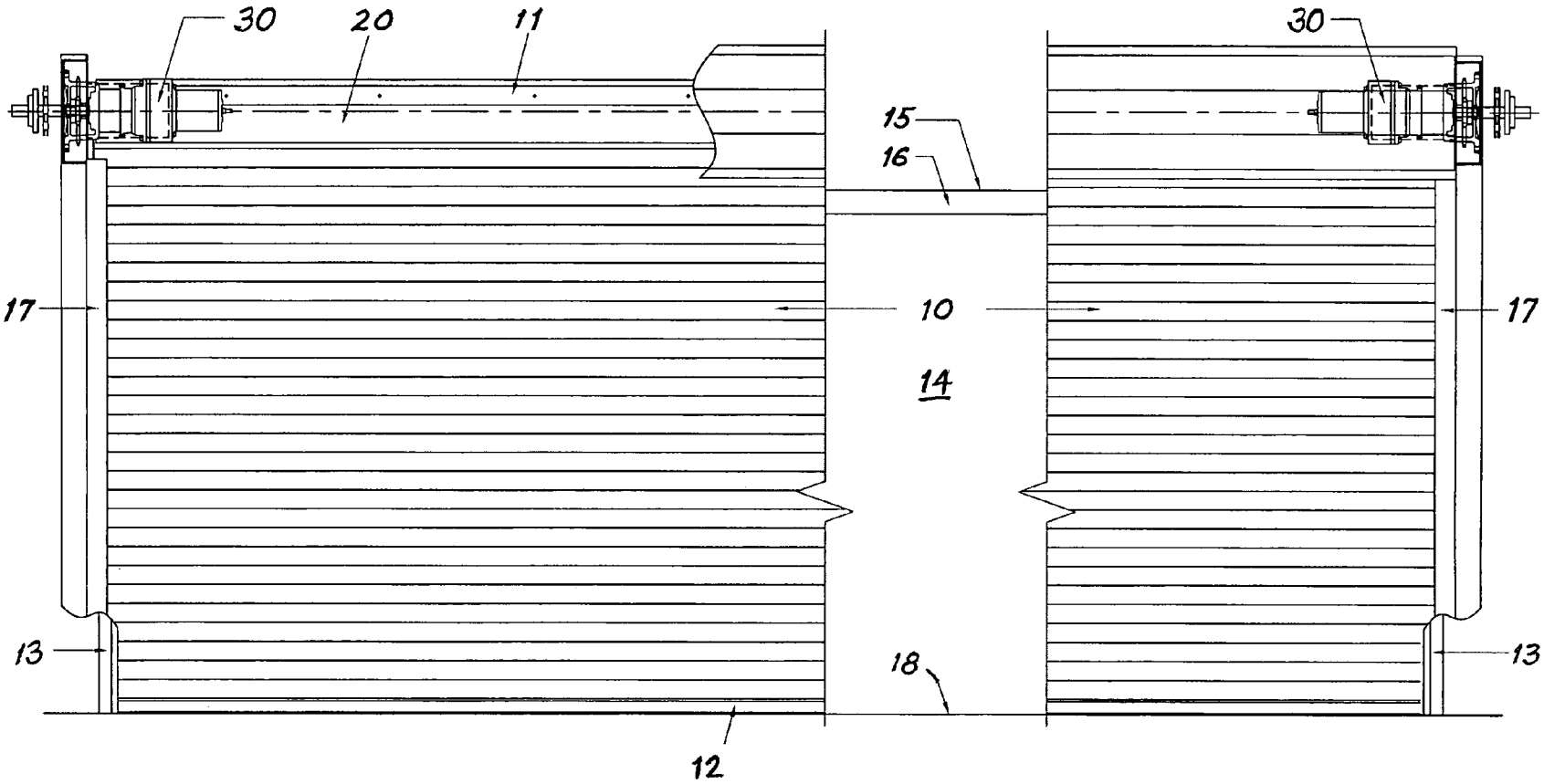
FIG. 1 shows a roller curtain with a drive arrangement according to an embodiment of the invention.

FIG. 1 shows a roller curtain 10 having a proximal edge 11 fixed to a drum 20, an opposing free edge 12, and lateral edges 13. In the closed position, as shown, the curtain 10 is unwound from drum 20 and extends to cover a vertical opening 14 defined by a frame 15 and floor 18. The frame 15 has a top 16 and side channels 17 which receive lateral edges 13 of the curtain. Motors 30 provided on opposite sides of the opening 14 provide the torque necessary to rotate the drum 20 and coil the curtain 10 thereon, as will be described.

Figure 2:
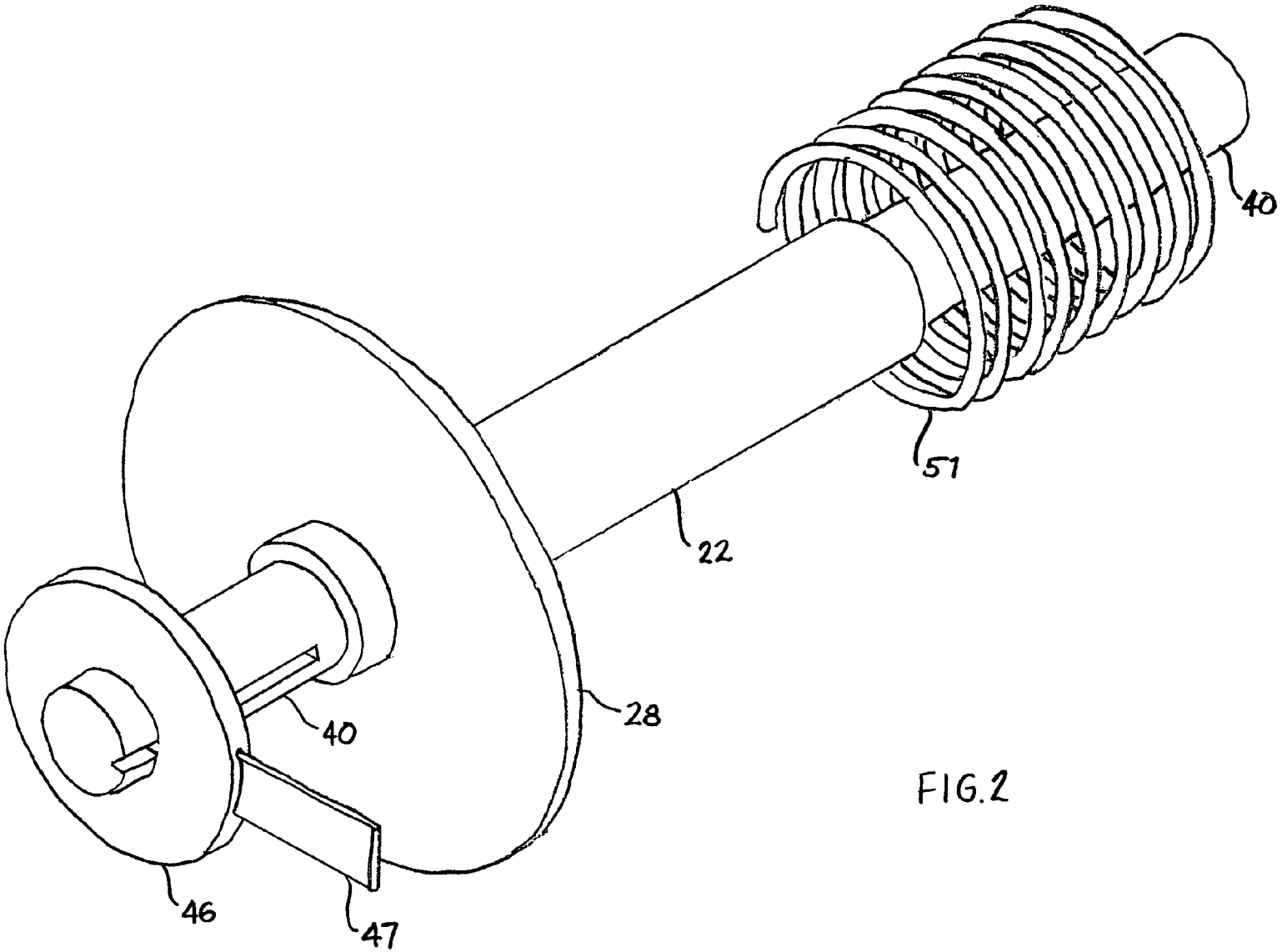
FIG. 2 is a schematic perspective view of the basic drive components of the roller curtain.
Figure 3A:
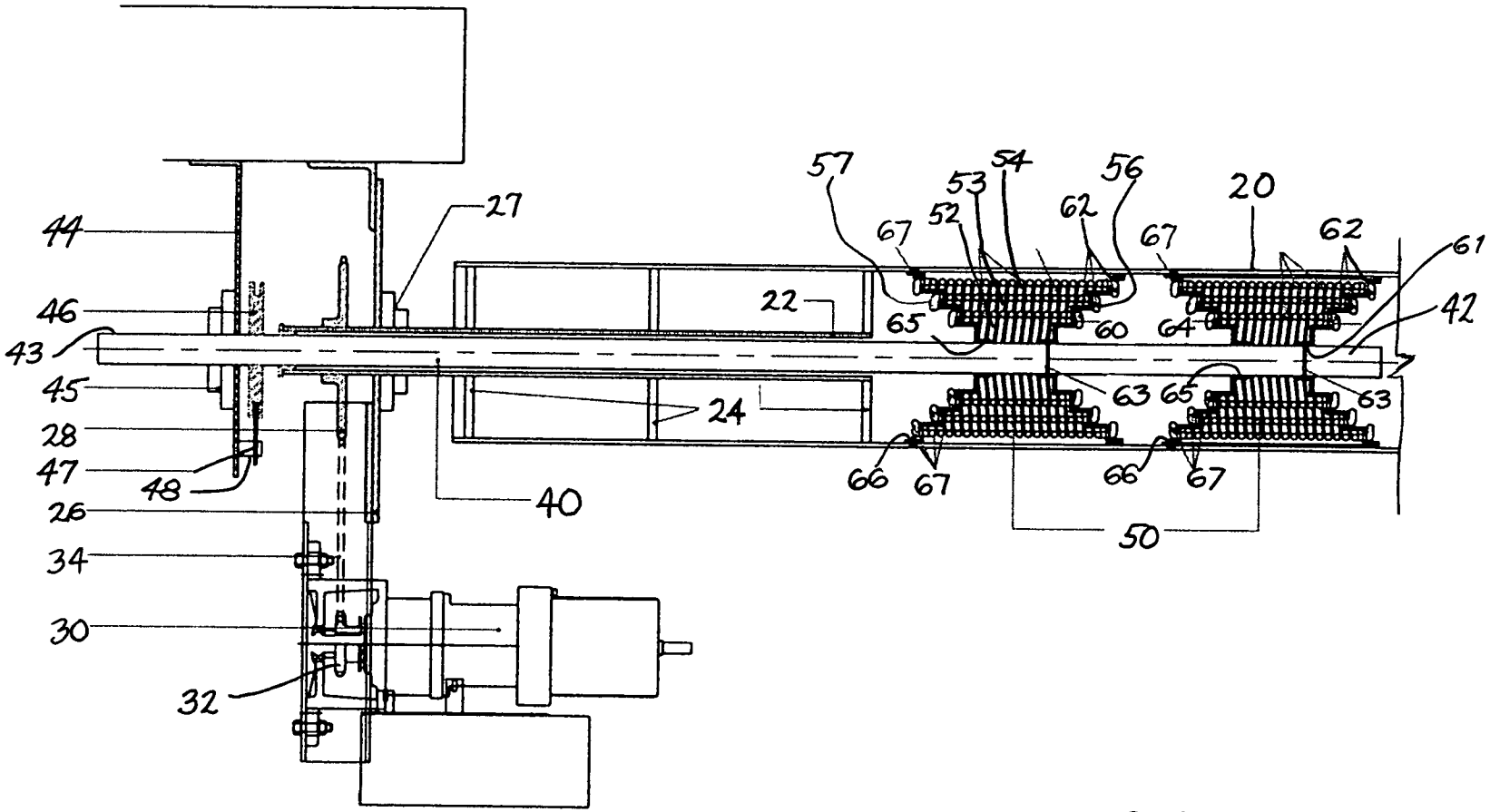
FIG. 3A is a left side elevation view of the drive arrangement according to an embodiment of the invention.

FIG. 2 shows the basic drive components for one side of the drive arrangement. These components include a hollow drive shaft 22 to which a driven sprocket 28 is fixed; a tension shaft 40 that is received through the hollow drive shaft 22 and is fixed to the door frame by a tension wheel 46 having a lever 47; and a torsion spring 51 that provides torsional loading between the hollow drive shaft 22 and the tension shaft 40. At the time of installation, with the roller curtain supported in an open or nearly open position, the lever 47 is fixed to the door frame. Typically, the spring 51 is one of a number of springs arranged to wind up or load as the roller curtain is closed. The springs are then loaded so that roller curtain tends to open, but remains in a closed position (under the weight of the curtain) until the drive shaft 22 is acted on by the motor 30 via sprocket 28 and a chain 34 (FIG. 3A). This arrangement lowers the load on the motor, while assuring that the curtain will remain closed until the motor is actuated.

Figure 3B:
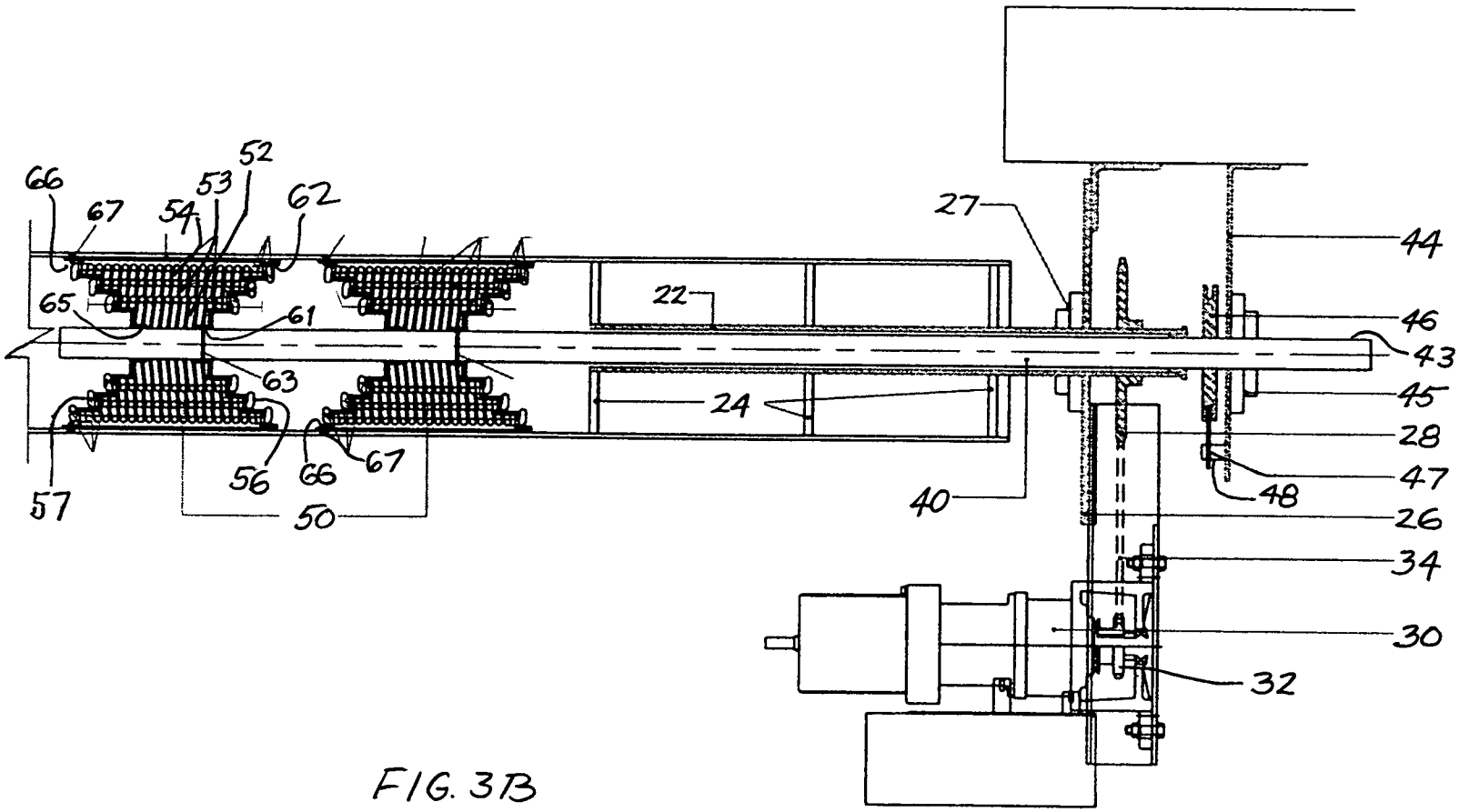
FIG. 3B is a right side elevation view of the drive arrangement according to an embodiment of the invention.

FIG. 3A shows a preferred embodiment of the drive arrangement on the left side of the door in greater detail. FIG. 3B shows the drive arrangement on the right side and is essentially the mirror image of FIG. 3A, wherefore the same reference numerals are used and one description will suffice for both figures.

The drum 20 is fixed to the hollow drive shaft 22 by annular disks 24 which are preferably welded in place. The hollow drive shaft 22 is journaled in a door bracket 26 by a bearing 27, and carries a driven sprocket 28 which is preferably fixed to the shaft 22 by bolts or pins so it can be removed. The driven sprocket 28 is connected by chain 34 to a drive sprocket 32 on the shaft of motor 30, which is also mounted on the door bracket 26.

The tension shaft 40 has an inner part 42 that extends beyond the drive shaft 22 inside the drum 20, and an outer part 43 that extends beyond the drive shaft 22 outside the drum 20. The outer part 43 is journaled in tension shaft bracket 44 by a bearing 45 and carries a tension wheel 46 that is preferably keyed to the tension shaft 40. The tension wheel 46 carries a lever 47 which not only facilitates loading the tension shaft, but may be fixed to the bracket 44 by pin 48 after loading.

The inner part 42 extends through two spring sets 50, each set consisting of three concentrically arranged coil springs 52, 53, 54 received between a first stepped cone 60 and a second stepped cone 64. The first stepped cone 60 has an inner collar 61 is which fixed to the tension shaft 40 by a pin 63, and an outer collar 62 which serves as a bearing for the drum 20. The second stepped cone 64 has an inner collar 65 which serves as a bearing for the tension shaft 40, and an outer collar 66 which is fixed to the drum 20 by a countersunk bolt 67. Each spring 52, 53, 54 has a hooked first end 56 which engages the first cone 60, and a hooked second end 57 which engages the second cone 64. This causes the springs to wind up or load as the curtain is closed, and to unwind or relax as the curtain is opened.

As shown in FIGS. 3A and 3B, the motors 30 are fixed to the door brackets 26 and linked to the hollow drive shafts 22 by sprockets 32, chains 34, and sprockets 28. Of course, other drive arrangements are possible. For example, the motor 30 could be linked to the hollow drive shaft 22 by a pair of helical gears. The motor operator could also be a "direct-drive" type without chains or gears. It is also possible to put a speed reduction unit and a brake in each drive train as described in U.S. Pat. No. 5,245,879.

While a vertical coiling door has been shown and described, it will be understood that the drive arrangement according to the invention can be used with a roller curtain covering an opening in a horizontal plane, such as an opening between floors, or any other angle, such as an opening in a pitched roof.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A drive arrangement for a roller curtain covering an opening defined by a frame, the arrangement comprising:

a drum for mounting horizontally across one side of the opening, the drum having an axis of rotation and axially opposite ends;

a pair of hollow drive shafts mounted concentrically inside respective said opposite ends of said drum, said drive shafts each having a diameter less than a diameter of said drum, said drive shafts being fixed against rotation with respect to said drum;

a pair of coaxial tension shaft portions received through respective said hollow drive shafts, each said tension shaft portion having an inner part extending beyond a respective said drive shaft inside said drum, and an outer part extending beyond a respective said drive shaft outside said drum;

at least one torsion spring associated with each said tension shaft portion, each said torsion spring comprising a coil surrounding a respective said inner part, each said coil having a first end fixed to said inner part and a second end fixed to said drum;

means for fixing each said tension shaft portion against rotation with respect to said door frame; and a pair of drive motors operatively connected to respective said hollow drive shafts for synchronously rotating said drive shafts in order to coil a roller curtain on said drum.

2. The drive arrangement of claim 1 comprising a plurality of torsion springs associated with each said tension shaft portion.

3. The drive arrangement of claim 2 comprising at least one set of concentrically mounted torsion springs associated with each said tension shaft portion.

4. The drive arrangement of claim 3 further comprising first and second stepped cones associated with each set of concentrically mounted torsion springs, wherein said first cone is fixed to said tension shaft portion and said second cone is fixed to said drum, and wherein said first end of each said torsion spring in said set is fixed to said first cone, and said second end of each said torsion spring in said set is fixed to said second cone.

5. The drive arrangement of claim 2 comprising a plurality of torsion springs mounted axially in tandem around each said inner part.

6. The drive arrangement of claim 1 wherein said tension shaft portions are formed by a single tension shaft extending through both of said hollow drive shafts.

7. The drive arrangement of claim 1 further comprising a plurality of annular disks fixing each said drive shaft to said drum.

8. The drive arrangement of claim 1 wherein said tension shaft portions can be rotated with respect to said door frame prior to fixing said tension shaft portions with respect to said door frame, thereby torsionally loading said springs to rotate said drum in a direction for coiling said roller curtain thereon, whereby said motors need not lift the entire weight of the roller curtain.

9. The drive arrangement of claim 8 wherein each of said motors is a three phase motor having 5 to 7.5 hp.

10. The drive arrangement of claim 1 further comprising a pair of door brackets in which respective said drive shafts are journaled by bearings, said motors being fixed to respective said door brackets.

11. The drive arrangement of claim 10 further comprising a sprocket fixed to each said drive shaft, and a pair of chains received around respective said sprockets, said chains being driven by said motors.

12. The drive arrangement of claim 1 further comprising a pair of tension shaft brackets in which respective said outer parts of said tension shaft portions are journaled by bearings.

13. A drive arrangement for a roller curtain covering an opening defined by a frame, the arrangement comprising:

a drum for mounting horizontally across one side of the opening, the drum having an axis of rotation and axially opposite ends;

a pair of hollow drive shafts mounted concentrically inside respective said opposite ends of said drum, said drive shafts each having a diameter less than a diameter of said drum, said drive shafts being fixed against rotation with respect to said drum;

a pair of coaxial tension shaft portions received through respective said hollow drive shafts, each said tension shaft portion having an inner part extending beyond a respective said drive shaft inside said drum, and an outer part extending beyond a respective said drive shaft outside said drum, wherein each said tension shaft portion can be fixed against rotation with respect to said door frame so that said hollow drive shafts can be rotated relative to said tension shaft portions;

at least one torsion spring associated with each said tension shaft portion, each said torsion spring comprising a coil surrounding a respective said inner part, each said coil having a first end fixed to said inner part and a second end fixed to said drum; and a pair of drive motors operatively connected to respective said hollow drive shafts for synchronously rotating said drive shafts in order to coil a roller curtain on said drum.

14. The drive arrangement of claim 13 comprising a plurality of torsion springs associated with each said tension shaft portion.

15. The drive arrangement of claim 14 comprising at least one set of concentrically mounted torsion springs associated with each said tension shaft portion.

16. The drive arrangement of claim 15 further comprising first and second stepped cones associated with each set of concentrically mounted torsion springs, wherein said first cone is fixed to said tension shaft portion and said second cone is fixed to said drum, and wherein said first end of each said torsion spring in said set is fixed to said first cone, and said second end of each said torsion spring in said set is fixed to said second cone.

17. The drive arrangement of claim 14 comprising a plurality of torsion springs mounted axially in tandem around each said inner part.

18. The drive arrangement of claim 13 wherein said tension shaft portions are formed by a single tension shaft extending through both of said hollow drive shafts.

19. The drive arrangement of claim 13 further comprising a plurality of annular disks fixing each said drive shaft to said drum.

20. The drive arrangement of claim 13 wherein said tension shaft portions can be rotated with respect to said door frame prior to fixing said tension shaft portions with respect to said door frame, thereby torsionally loading said springs to rotate said drum in a direction for coiling said roller curtain thereon, whereby said motors need not lift the entire weight of the roller.

21. The drive arrangement of claim 13 wherein the hollow drive shafts are journaled directly on the tension shafts.

22. The drive arrangement of claim 1 wherein the hollow drive shafts are journaled directly on the tension shafts.

23. The drive arrangement of claim 13 wherein said drive shafts each have a first portion that extends in an axial direction within said drum and a second portion that extends in an axial direction outside and beyond said respective end of said drum.

24. The drive arrangement of claim 1 wherein said drive shafts each have a first portion that extends in an axial direction within said drum and a second portion that extends in an axial direction outside and beyond said respective end of said drum.

* * * * *